United States Patent [19]

Hung

[11] Patent Number: 4,715,787

[45] Date of Patent: Dec. 29, 1987

[54] COAXIAL, TWO-CYLINDERED AIR COMPRESSOR

[75] Inventor: Michael Hung, Taipei, Taiwan

[73] Assignee: Utility Electronics Industries Co. Ltd., Taipei, Taiwan

[21] Appl. No.: 845,854

[22] Filed: Mar. 28, 1986

[51] Int. Cl.[4] ..... F04B 39/00; F04B 35/04

[52] U.S. Cl. ..... 417/63; 417/234; 417/313; 417/411; 417/415; 417/521; 362/387; 362/802

[58] Field of Search ..... 417/63, 234, 313, 411, 417/415, 521, 533, 534; 362/802, 387, 276

[56] References Cited

U.S. PATENT DOCUMENTS

| | | | |
|---|---|---|---|
| 1,513,873 | 11/1924 | Tasky | 417/533 X |
| 1,566,620 | 12/1925 | Scoville, Jr. | 417/521 X |
| 1,647,818 | 11/1927 | Semak | 417/411 X |
| 1,818,413 | 8/1931 | Luitwieler | 417/534 X |
| 1,842,027 | 1/1932 | Jonn | 417/415 X |
| 2,759,665 | 8/1956 | Wilber | 417/534 X |
| 3,137,139 | 6/1964 | Stordahl | 417/415 X |
| 4,136,381 | 1/1979 | Bone | 362/387 X |
| 4,187,058 | 2/1980 | Fish | 417/234 |
| 4,389,166 | 6/1983 | Harvey et al. | 417/234 |
| 4,614,479 | 9/1986 | Liu | 417/234 X |
| 4,621,984 | 11/1986 | Fussell | 417/234 |

FOREIGN PATENT DOCUMENTS

| | | | |
|---|---|---|---|
| 2157775 | 10/1985 | United Kingdom | 417/415 |

*Primary Examiner*—William L. Freeh
*Assistant Examiner*—Paul F. Neils
*Attorney, Agent, or Firm*—Browdy and Neimark

[57] ABSTRACT

Coaxial, two-cylindered air compressor, more specifically an air compressor capable of continuous air exhausting and air feeding, has a cylinder provided at either end of a main frame; to the underside of the main frame is extended a link so that serves to displace pistons in both cylinders, that by the provision of a crank pin both are fitted by articulation to the shaft side of a crank case, so as to facilitate engagement of the motor on top of the main frame with reduction gears on the upper side of the shaft lever by means of transmission gears on the shaft center, thereby setting the crank case to rotation, so that both of the cylinders may exhaust and suck air in a continuous manner, thereby reducing airfeeding, and airsucking time.

1 Claim, 11 Drawing Figures

COAXIAL, TWO-CYLINDERED AIR COMPRESSOR

SUMMARY OF THE INVENTION

The present invention provides a coaxial, two-cylindered air compressor, in substance comprising a main frame having a cylinder provided on either side thereof, both cylinders lining up colinear with each other, so that the link that drives the piston to displacements in both cylinders may extend to the underside of the main frame, in order that a motor that is fitted to the upper side of the main frame may secure engagement with the reduction gear of the shaft lever by means of transmission gears fitted to the core of the shaft, thereby setting the crank case to concurrent rotation, bringing the pistons in the cylinder as driven by the links to effect reciprocating displacements, so as to cause the two cylinders to alternative air sucking, exhausting performances, thereby achieving continuous air sucking, exhausting effects; in the meaintime, the inertia of one cylinder is made use of to drive the piston of the other cylinder, thereby achieving a reduction of air feeding, air sucking times with the discharging of high pressured gas pressure accomplished in abundant gas flow rates.

The very fact that almost all the existing and conventional air compressors are composed of but one air cylinder exposes the air compressors to many disadvantages in use, and this presents quite an inconvenience to the consumers too; the major defects found with a conventional air compressor in use include:

(I) very limited air flow rates due to intermittent interruptions as a result of alternative air intake, air exhaustion taking place one following the other; inevitable for single cylinder operations;

(II) prolonged air intake, air filling times as a result of intermittent air feedings;

(III) relative smaller air pressure in case of greater air flow rates; relative greater air flow rates in the case of greater air pressure; such that conventional air compressors are useful only for specific objects. For example, air compressors of the type of greater air flow but smaller air pressures are suitable for use with rubber boats, swim tires and the like, but hardly recommendable for use with vehicle tires and other requiring higher rates of air pressure.

(IV) lack of stability to the loads of single cylinders, this being detrimental to the service life of relevant parts in association. This is because while the single air compression cylinder is active in operation, the load due to exhaustion is greater than the load to air intake, so that the overall load is constantly going through up-heavals, which have doubtless negative effects on the components and parts.

(V) the scope of applications of existing types of air compressors is very limited, the economical effects left much to be desired of.

In view of the foregoing, the inventor betook himself to the research, by taking into account his experiences over the years relating to the making of communication instruments, of a coaxial, two-cylindered, air compressor, and finally succeeded in the presentation of the present invention, with a view to eliminate all such defects found out of the use of all kinds of existing and conventional air compressors.

Accordingly, the primary objective of the present invention is to provide, in view of the many defects found out of the use of all conventional and existent air compressors, the structure of a coaxial, two-cylindered air compressor which makes possible the air feeding and air suction in a more prompt execution, thereby the reduction of air filling/air intake durations.

A further objective of the present invention lies in the provision of a coaxial, two-cylindered air compressor, whereby the air feeding, air suction is achieved by two cylinders in order, so as to gain a continuous output air flow substantially greater than ever according to conventional executions.

A further objective of the present invention lies in the provision of a coaxial, two-cylindered air compressor, wherein the running of two coaxially positioned gas cylinder will suffice to result in the transmission of a second cylinder by the inertia of the first cylinder, so as to yield a high pressured output.

A further objective of the present invention lies in the provision of a coaxial, two-cylindered air compressor, whereby air feeding and air suction operations will be run by the two cylinders alternatively so as to help realize a stable loading, thereby helping to increase the service terms of the components.

A further object of the present invention lies in the provision of such a coaxial, two-cylindered air compressor, wherein a flicker is provided in series with the lamp circuit, serving as a warning sign or an illuminator by intermittent illumination or steady illumination as the case may require.

Other features and advantages of the present invention will emerge from the following descriptions of embodiments given by way of illustration, but not in any way limiting, with reference to the accompanying drawings in which:

A description of the reference numbers follows:

| | |
|---|---|
| 10 motor | 11 shaft end bushing |
| 12 shaft front bushing | 13 reduction gear |
| 14 main frame | 15 piston |
| 17 cock | 20 two-way joint |

-continued

| | |
|---|---|
| 23 cylinder | 24 link |
| 25 crank pin | 26 three-way joint |
| 28 transmission gear | 29 crank case |
| 30 rubber tube | 31 tubing |
| 32 pressure gage | 33 four-way joint |
| 34 tubing | 35 two-way joint |
| 36 four-way joint | 37 power line |
| 38 power plug | 39 air guide |
| 40 adaptor | 41 motor key |
| 42 bulb key | 43 flicker |
| 44A, 44B arm support | 45 bulb |
| 46 reflection board | 47 hood |
| 48 case lid | 49 casing |
| 50 air pressure cylinder | 52 gas exhaust |
| 51A, 51B, 51C, 51D pad | 53 intake pipe |

DETAILED DESCRIPTION

Figure 9:
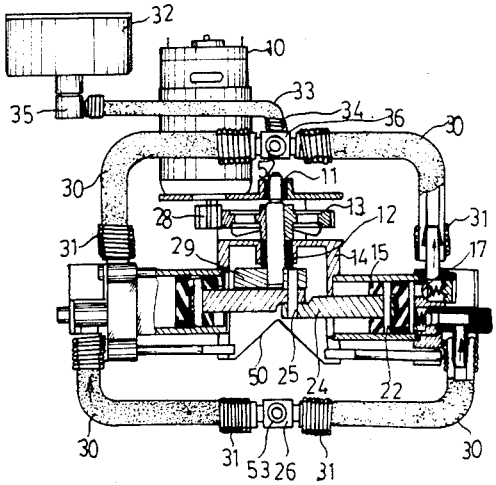
FIG. 9 is a perspective of the transmission system embodied in the invention coaxial, two-cylindered air compressor.
Figure 8:
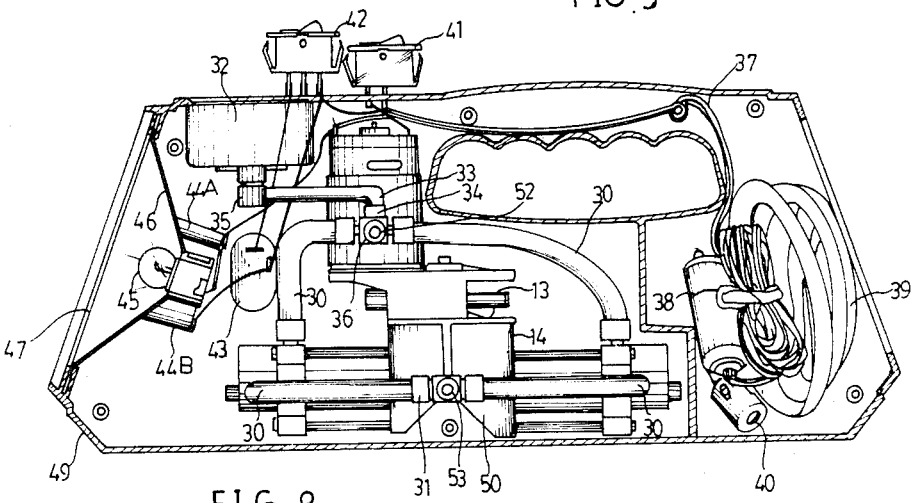
FIG. 8 is sectional perspective, taken along the length side of the invention coaxial, two-cylindered air compressor.
Figure 10:
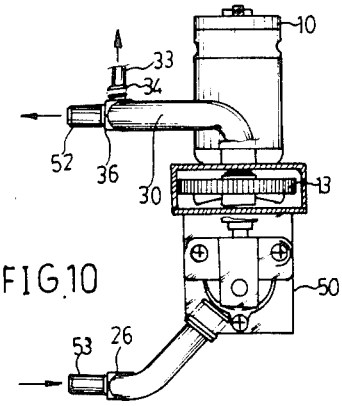
FIG. 10 is a back view of the cylinder as employed in the invention coaxial, two-cylindered air compressor.

As is shown in the accompanying drawings, the present invention is composed of such essential units as the motor 10, the pressure gage 32, the flicker 43, the bulb 45, the case lid 48, the casing 49, and the cylinder proper 50, including other components. Referring to FIG. 8, FIG. 9 it will be seen that the source of power, the motor 10, is mounted on top of a main frame 14, the armature of the motor 10 facing downwards, the shaft of the motor 10 passing the mounting surface of the main frame 14 and extending down, so that a transmission gear 28 is coaxially connected with the motor shaft, so that the transmission gear 28 is brought into engagement with reduction gear 13, so that the shaft core of the reduction gear 13 can bring the crank case 29 in the cylinder proper 50 to rotation, so that the piston 15 in the cylinder 50 can perform reciprocating movements conductive to the intake and discharging, of air.

The reduction gear 13 and the semi-circular crank case 29 share a common axis, an annularly shaped end shaft bushing 11 and a front shaft bushing 12 being provided in going from the top side of reduction gear 13 and the lower side of the reduction gear 13, to the crank case 29, this in order to bring the reduction gear 13 and the crank case 29 fitted by articulation to the interior of the main frame 14. In addition, the rim of the reduction gear is duly engaged with the transmission gear 28 of the motor 10, in order that the motor 10 in rotation can bring reduction gear 13 to follow-up rotation by means of transmission gear 28, so that the axis inside the main frame 14 can run about smoothly in step with reduction gear 13, so that the crank case 29 down the axis can bring piston 15 to displacements by dint of link 24.

The air pressure cylinder 50 is in substance composed of two cylinders lying on a same horizontal axis. On either terminal of each cylinder are provided two vents each blocked by two spherical cocks 17, duly biased to position by a spring provided underneath, and laid out opposite each other, such that the vent is seen at the right side of FIG. 9 serves as a discharging duct, whilst the other cock serves as the air intake duct; the piston 15 in the cylinder is in connection with link 24 by way of a cross pin 22, so that the terminal end in association with link 24 can swing about in the notch in the piston 15, so as to facilitate reciprocating displacements of piston 15 and the pushpulling of link 24.

Figure 11:
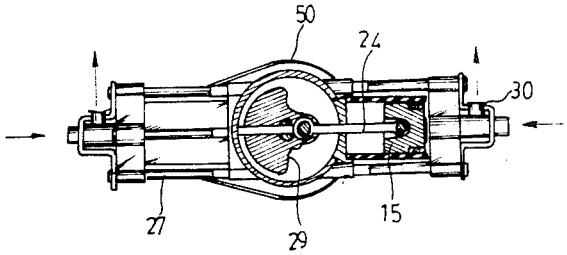
FIG. 11 is a sectional perspective of an illustrative cylinder as employed in the invention coaxial, two-cylindered air compressor.

The link 24 interconnecting both cylinders extends into the main frame 14, overlapping the terminal notch of the link 24, and so as to bring the round hole in the link 24 aligned to the gap of the crank case 29, so as to permit introduction therein of a crank pin 25, the three of them united together as such will permit rotation of the crank pin 25 around the axis of the crank case 29, while the two links 24 can rotate as a function of the crank pin 25, this eventually resulting in a push given to or else a pull of the piston 15 to exert reciprocating movements. From FIG. 9 and FIG. 11 it is further seen that as the link 24 interconnecting both cylinders is fitted by articulation by means of crank pin 25 to the rim of the axis of crank case 29, rotation of the crank case 29 will result in a pull of the piston 15 by that portion of the link 24 inside one cylinder, for displacements towards the main frame 14, concurrent with a suction of the air intake duct 53 into the cylinder, in the meantime, as the link 24 relative to the other end of the cylinder is working to push the piston 15 outwards, the air in the cylinder being extruded by piston 15, will bring up the air pressure gradually, this eventually forcing the air cock 17 in the discharge duct to displacements such that the high pressured gas will, by the conduction of rubber tube 30, pass to the discharge tube 52 in association with the four-pass joint 36, this causing on end of a tubular air duct 39 to get bolted over discharge tube 52, and the other end thereof can be applied by means of an adapter 40 to the air intake port of an object article to be inflated such as vehicle tire or swim tire, so that air may be filled into the object article. And conversely, as a function of the crank case 29 rotation, the cylinder from which air is forced out will move towards the main frame side as a result of its piston 15 being pulled by the link 24, so that the discharge tube is blocked as a result of the gas cock 17 being biased closed by the spring at bottom because of a lesser pressure inside the cylinder as related to that prevailing at the discharge side 52, whilst the other air intake duct compels the air cock 17 in the air intake passage to shrink inwards as a result of the pressure inside the cylinder being smaller than that prevailing at the intake port 53, so that air from the atmosphere may get sucked into the cylinder via intake 53; in the meanwhile, as stated hereinbefore, the cylinder of the other side will function to force out the air therefrom, so that outgoing gas duly guided by a rubber tube 30 on the other side may pass to the exhaust tube 52 from the four-pass joint 36, thereby achieving charging of air into an object article. So it appears clear that in as much as the invention air compressor is in a working state, air suction will take place in one of the two cylinders while the other is discharging, this occuring alternatively so that the discharge tube 53 may maintain continuous, rhythmical discharging of high pressured gas while the air intake tube 53 maintains constant, continuous intake of outside atmosphere, so that eventually gas may become readily available for charging into an object article, or alternatively vacuum may be used so as to suck out the gases theretofore accumulated in an object article. All this corrects existing defects so far known in conventional single cylinder air compressors, such as, 1. discharging and air suction performed intermittently; 2. loading conditions unstable, endangering the service term of components; whereas under the invention hereof, the service term of all essential parts such as motor 10, crank case 29, link 24 may be extended because of the functioning stresses better exposed to stability and equilibrium as the crank case 29 is set to rotation, what with the discharge of higher pressures realized by virtue of the inertia due to one cylinder serving to transmit the piston of the other cylinder thanks to symmetrical running of two-side-by-side cylinder twins, provided hereunder.

Referring to the drawings there is further seen needle type pressure gauge 32 mounted on the casing 49, whose round surface points outwardly, and its bottom in association with a two-pass joint 35 (FIG. 8), so that the other end of the two-pass joint 35 may associate itself with the four-pass joint 36 by means of a small rubber pipe 33 fitted by a helicoid tubing 34, whereby it is made possible to have the discharging pressure indicated on the pressure gage 32.

On the top of the main frame 14 there is mounted the interconnective four-pass joint 36, whose one end is connected with pressure gage 32 by means of the small rubber tube 33 duly fitted by the helicoid tubing 34, and another end thereof is the discharge tube 52 having threaded outer rim, extended outside the casing 49, to facilitate linkage with air duct 39, the remaining two ends thereof form a couple of symmetrical exhausts of the twin cylinders, in association with a rubber tube 30 duly fitted by helicoid tubing 31, so that exhausts from the cylinder may be fed out via discharge tube 52.

There is provided in addition the three-pass joint 26 structured pretty much the same as the four-pass joint 36, but short of elements in connection with the pressure gage 32, including an air intake 53 with threaded outer periphery extending outside the casing 49, situated underneath the discharge tube 52, for connection with guides.

Figure 1:
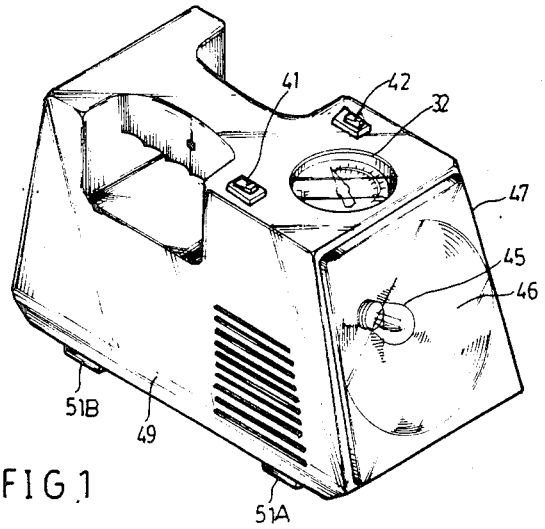
FIG. 1 is a three-dimensional perspective of the invention titled coaxial, two-cylindered, air compressor.
Figure 2:
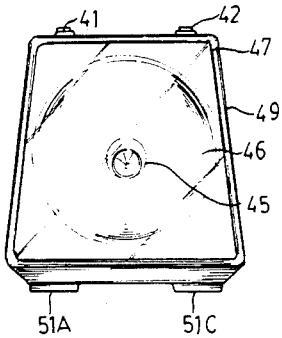
FIG. 2 is a frontal view of the invention coaxial, two-cylindered air compressor.
Figure 3:
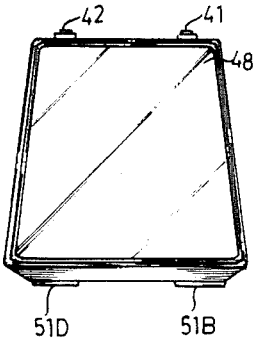
FIG. 3 is a back view of the invention coaxial, two-cylindered air compressor.
Figure 4:
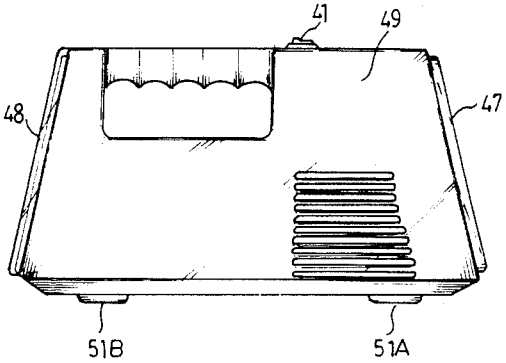
FIG. 4 is a left side view of the invention coaxial, two-cylindered air compressor.
Figure 5:
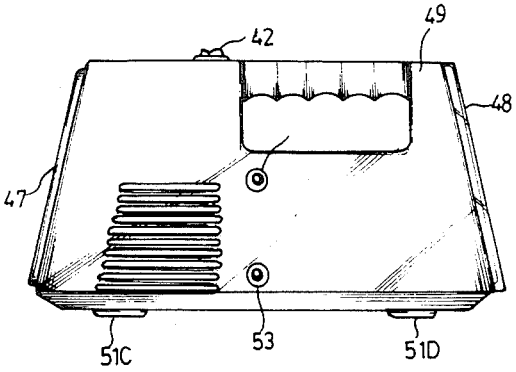
FIG. 5 is a right side view of the invention coaxial, two-cylindered air compressor.
Figure 6:
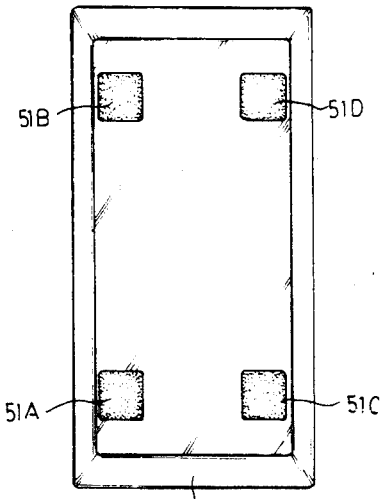
FIG. 6 is a bottom view of the invention coaxial, two-cylindered air compressor.
Figure 7:
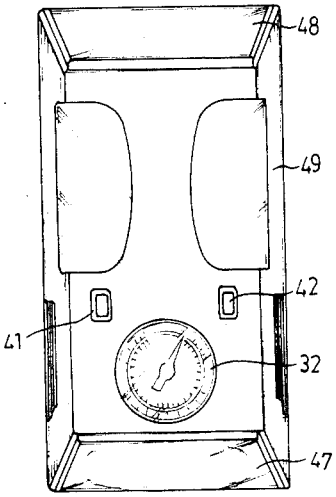
FIG. 7 is a top view of the invention coaxial, two-cylindered air compressor.

Referring to FIG. 7, FIG. 8 it will be seen that on the top of the casing 49 are provided two pushkey switches, one of them of which is the motor pushkey 41, for control of the rotation of the motor 10, the other being a light-bulb pushkey 42 having a three-shift control device so that, a push forwards of it will set the bulb 45 in the middle of the reflection board 46 to sustained illumination; and a push of it towards the center will turn off the bulb 45, whilst a push of the bulb key 42 rearwards will bring an ellipsoid flicker 43 in series connection with the bulb 45, the flicker 43 containing a thermoheater within so that passage of current therethrough will give heating effects to the thermoheater thereby increasing the temperature such that the two contacts within will break away to bring the circuit to an open condition, whereas once the temperature has gone down again closure of the contacts will result once again, so that the thermoheater will heat up later on to bring up the temperature again, such that a cycle repeated all over again will yield a flickering lighting of the bulb 45, thereby achieving warning effects.

As pointed out hereinbefore, the bulb 45 is positioned straight in the center of the reflector board 46, the reflector board 46 being supported over the back by two insulation arm rests 44A, 44B, through which conductors may line up to provide a closed loop for the bulb 45; the reflector board 46 is positioned at such a position in front of the casing 49 so that incident lights from bulb 45 may reflect outwards owing to the focusing effects of the reflector board 46, by way of a transparent hood 47 established in front.

A rectangular casing 49 serves to house all the elements and components of the subject invention, and is complete with a handle with wavelike holder, hollow-treated on the back thereof, to facilitate handling and carriage by hand; still on the rear section thereof is provided a storage space to permit the disposition therein of such items as air guide duct 39, adaptor 40, power line 37, power socket 38, etc. Furthermore, a color-coated transparent case lid 48 is attached to the outer rim of the terminal end of the casing 49, to keep all the attachments from falling out. The case lid 48, on being held up to open position, may be disposed by insertion front of the casing 49, that is, the end furnished with bulb 45, this, in concert with the flickering demonstration of bulb 45, will serve to keep succeeding traffic alerted and on guard, if the case lid 48 is coated red, in a preferred execution hereof. On each of the four corners of the bottom of the casing 49 is provided a square shaped base pad 51A, 51B, 51C, 51D respectively to help reinforce the supporting effects.

To sum up, the purposes for and the meritorious points of the present invention are as follows:

1. Shortening of inflation/air suction time by continuous inflation, air suction operations by virtue of the provision of a pair of coaxially disposed cylinders.

2. The realization of high pressured gas output and greater gas flowing rates which are indispensable for effective inflations;

3. The incorporation of a pressure gage working by the measurements of the passing gas pressure in a given moment;

4. The provision of illumination means and instruments;

5. The incorporation of flicker device, to account for warning signs in conjunction with color-coated transparent case lids;

6. The achievement of stabler loading conditions to extend the life of service of all working elements and components.

Although the present invention has been described in relation to particular embodiments, it is not limited by them, but on the contrary is capable of modifications and variants which will be apparent to a person skilled in the art, upon the reading and understanding of the present specification.

I claim:

1. Two-cylindered air compressor sharing a common axial line, comprising:

an outer casing;

a main frame disposed inside the outer casing an penetrating, in association with, strutting supports;

a gas cylinder proper composed of two cylinder members sharing a common axis positioned on either side down the main frame with each cylinder member having an intake port and an outlet port;

a motor as the source of transmission of the cylinder members positioned up the main frame;

a transmission gear, fitted to the shaft core of the motor for the purpose of transmission engagements;

a reduction gear, fitted by articulation over the top of the main frame, for interactive engagement with the transmission gear;

a backside shaft bushing, positioned over the main frame and the reduction gear, serving to fit by articulation the shaft member of the reduction gear;

a front side shaft bushing, positioned inside the main frame and beneath the reduction gear, serving to fit by articulation the shaft member of the reduction gear;

a pressure gage, mounted over the shell casing, with which the reading of the output gas pressure is taken;

a two-pass joint bolted to the bottom side of the pressure gage;

a three-pass joint, established on the underside of the interior of the shell casing, of which one end is thread-coated and extending beyond the outside to serve as an air intake passage;

a four-pass joint, established over the interior of the shell casing of which one end is extended beyond the casing, duly thread-coated, to serve as a discharging path;

a small rubber tube, interconnecting the two-pass joint with the four-pass joint;

means to fasten the small rubber tube in position;

a plurality of rubber tubes, used to interconnect the two outlet ports of the cylinder members and the four-pass joint, and to interconnect the two intake ports of the cylinder members with the three-pass joint;

a plurality of tubing guides to fix the fitting of the rubber tubes;

a motor pushkey, as a control of the motor and fitted to the upper side of the shell casing;

a light-bulb, fitted ahead of the shell casing, and having a bulb circuit to provide electricity thereto;

a reflection board, fitted in front of the shell casing;

a flicker, in series connection with the bulb circuit inside the shell casing, serving as the command of the bulb, flashing or otherwise;

a case lid to close access at the rear side of the shell casing, said case lid being a transparent lid applied with a color coating, which, once fixed to the shell casing, will keep attachments and accessories tightly secured in the casing, and which, when attached to the frontal end of the shell casing, will achieve alerting, warning effects in conjunction with the flickering of the bulb;

the four-pass joint, by means of the rubber tube, bringing the outlet port of each cylinder member, in conflux into the joint, so that as the motor on top of the main frame drives the cylinder members to activation, one such cylinder member will perform suction of atmospheric pressure whilst the other will discharge at all the same time, thereby achieving the operation of continuous inflation and air inhalations all at once.

* * * * *